United States Patent [19]

Brunemann

[11] 4,345,888

[45] Aug. 24, 1982

[54] APPARATUS FOR PRODUCING PREFABRICATED MODULAR BUILDING PANELS

[76] Inventor: James C. Brunemann, R.R. 5, P.O. Box 31, Brookville, Ind. 47012

[21] Appl. No.: 201,219

[22] Filed: Oct. 27, 1980

[51] Int. Cl.[3] ..... B28B 7/22; B28B 21/96

[52] U.S. Cl. ..... 425/117; 425/218; 425/456

[58] Field of Search ..... 264/256, 333, 275, 278; 249/83, 85; 404/114, 118; 425/62, 215, 218, 456, 110, 125, 117

[56] References Cited

U.S. PATENT DOCUMENTS

| | | | |
|---|---|---|---|
| 2,255,342 | 9/1941 | Baily | 404/114 |
| 2,255,343 | 9/1941 | Baily | 404/114 |
| 2,531,576 | 11/1950 | McClellan et al. | 264/256 |
| 3,396,642 | 8/1968 | Martinson | 404/114 |
| 3,681,484 | 8/1972 | McKie | 425/456 |
| 3,775,529 | 11/1973 | Steenson et al. | 425/218 |
| 3,838,933 | 10/1974 | Lehman et al. | 404/114 |
| 4,102,973 | 7/1978 | Hanning | 264/278 |
| 4,133,859 | 1/1979 | Piazza | 264/256 |
| 4,185,437 | 1/1980 | Robinson | 264/256 |
| 4,261,694 | 4/1981 | Morrison | 425/456 |

FOREIGN PATENT DOCUMENTS

| | | | |
|---|---|---|---|
| 2131324 | 10/1972 | Fed. Rep. of Germany | 425/456 |
| 2071453 | 8/1971 | France | 425/426 |

*Primary Examiner*—Willard E. Hoag
*Attorney, Agent, or Firm*—Frost & Jacobs

[57] ABSTRACT

An apparatus for applying an exterior layer of cementitious material to a partially assembled prefabricated modular building panel of the type having a rigid framework composed of a plurality of rigidly interconnected stud members and a support base secured to the framework having an outer surface configured to retain the cementitious material. The apparatus includes a conveyer-like support bed for fixedly holding the panel framework in place, and a continuously moving elongated toothed screed which spreads and textures the cementitious material over the outer surface of the panel support base. The screed is driven by a cable arrangement which insures constant tension and prevents tracking of the cable. The vertical position of the screed blade may be adjusted with respect to the layer of cementitious material to provide a uniform thickness on the panel. As the screed traverses the panel surface it is simultaneously vibrated to work the cementitious material into the metal lath. In an alternate embodiment, the scraper screed may be replaced by a roller for working aggregate material into the cementitious coating.

31 Claims, 14 Drawing Figures

APPARATUS FOR PRODUCING PREFABRICATED MODULAR BUILDING PANELS

SUMMARY OF THE INVENTION

The present invention is directed to apparatus for applying a smooth or textured cementitious coating to the exterior of a prefabricated modular building panel.

As is well known in the art, such modular panels are generally individually combined and assembled, usually on the ground at a location apart from the building site. The completed modular panel may then be hoisted into place and secured to the appropriate position on the building superstructure. It has been found that such modular construction techniques greatly simplify the effort required to erect the exterior building walls and permit the use of architectural effects which could not otherwise be achieved.

Generally, such panels include a supporting framework of rigidly interconnected metallic stud members arranged to provide the necessary structural support, while permitting openings for doors, windows and the like. The stud members may be accurately located to form the panel framework by means of a fabricating fixture such as that described in my U.S. Pat. No. 3,945,630 issued Mar. 23, 1976 for "Assembly Support for Pre-Fabricating Building Panels" as will be explained in more detail hereinafter.

Overlying layers of exterior gypsum sheeting, felt paper and metal lath are securely attached to the framework formed by the interconnected stud members to provide a supporting base for an exterior coat of textured cement, modified cement or other cementitious material.

Conventional modular building panels of the type described are generally assembled with the panel in a horizontal position at a location away from the building site. The exterior cementitious layer or coating is usually applied manually by artisans and requires a fair degree of skill to assure a uniformly textured appearance and to prevent voids which might reduce the structural integrity of the panel. Such manual fabrication methods become more time consuming and difficult when the modular panel must be provided with other than a smooth exterior surface. For example, often the surface is provided with ribs, flutes or the like to produce the desired architectural appearance when the panel is installed in place on the building exterior. Furthermore, the increasing demand for panelized construction using modular building panels of this type has exceeded the ability of the industry to produce the panels by conventional hand-made fabrication methods.

The apparatus of the present invention greatly simplifies and promotes the fabrication of such modular building panels by enabling the exterior cementitious coating to be appplied, smoothed and textured in one continuous automatic operation. In a preferred embodiment, the present invention includes a generally horizontal planar bed having a plurality of spaced rotatably mounted rollers for supporting the framework of the partially completed modular building panels in a horizontal orientation with the outer surface of the supporting base formed by the gypsum sheeting, felt paper and metal lath facing upwardly. The apparatus may be installed at a fixed location at some distance from the building construction site, or may be constructed so as to be easily disassembled and reassembled at or near the building location. For example, the apparatus of the present invention may be installed on an intermediate floor of the building under construction to minimize the distance the completed modular building panels must be moved to the final point of installation.

In the preferred embodiment illustrated, the rollers associated with the bed form a conveyor-like structure which facilitates movement of the partially completed panel framework onto the apparatus, and removal of the completed modular building panel from the bed. Clamp means, adjustable to accommodate particular widths or shapes of the building panels, are provided to hold the panel framework in a fixed position on the bed.

After the panel framework has been secured in place, the overlying layers of exterior gypsum sheeting, felt paper and metal lath are securely attached to the framework formed by the interconnected stud members to provide the supporting base.

The apparatus of the present invention further includes screed means overlying the bed for spreading and texturing an external layer or coating of cementitious material applied to the outer surface of the panel supporting base. In general, the cementitious material may comprise concrete or a concrete-like slurry, and may further be provided with particles or aggregate, depending upon the particular visual appearance desired.

The screed means includes an elongated screed extending transversely across the apparatus bed and movable along the longitudinal axis of the bed. The lower edge of the screed forms an elongated texturing blade which is vertically positioned to contact the exterior layer of cementitious material applied to the outer surface of the supporting base of the panel and is configured to produce a desired surface texture in the cementitious layer as the screed is moved along the bed. As will become apparent from the detailed description which follows, the texturing blade may be provided with a serrated or toothed edge to produce an exterior panel surface having alternating ribs and flutes.

The ends of the screed are supported on spaced parallel extending box-like guide rails positioned along the longitudinal edges of the bed by supporting means which insure parallel movement of the screed along the surface of the building panel. Each support means includes a wheel-like guide rotatably secured to the screed in rolling contact with the outer surfaces of the box-like guide rail. The guides operate to restrict movement of the screed to a direction parallel to the longitudinal axis of the bed.

The vertical position of the screed may be adjusted with respect to the outer surface of the panel supporting base to insure that the cementitious coating is adequately worked into the metal lath and to control the ultimate thickness of the exterior cementitious coating as well as eliminate voids therein. In addition, the screed is provided with a plurality of spaced vibrators which facilitate working of the cementitious material as the screed traverses the upper surface of the building panel.

The screed means is traversed in a direction generally parallel to the longitudinal axis of the bed by means of a continuous flexible cable forming a closed loop which is secured at spaced points along its length to the ends of the screed adjacent the support means.

A generally cylindrical roller bearing a helical groove on its outer surface is positioned adjacent one end of the bed. Several turns of the flexible cable are wrapped about the roller such that a relatively constant tension is maintained in the cable. The roller is nonrotatably mounted by means of linear spline bearings to a splined shaft thereby permitting linear motion between the shaft and the roller. As will be explained in more detail hereinafter, this construction prevents tracking of the cable.

Motor means are provided for rotating the shaft at a generally constant speed in a first direction which causes the cable to move the screed means in a direction toward the roller means, thereby spreading and smoothing the cementitious material over the outer surface of the supporting base. When the screed reaches its limits of travel, as detected by magnetic limit switches, means are provided for reversing the direction of rotation of the splined shaft to cause the cable to move the screed means in a direction away from the roller means. In the reverse mode of traverse, the screed may be lifted out of contact with the cementitious coating, if desired.

Following one or more passes of the screed over the surface of the building panel, the surface of the cementitious material will be left with the desired texture. The completed panel may then be easily removed from the bed and stored for subsequent transport to the point of installation.

Further features of the invention will become apparent from the detailed description which follows.

BRIEF DESCRIPTION OF THE DRAWING

FIG. 3 is a top plan view of the apparatus of the present invention with the screed means in an intermediate position.

FIG. 13 is an electrical schematic diagram of the control means of the apparatus of the present invention.

DETAILED DESCRIPTION

Figure 1:
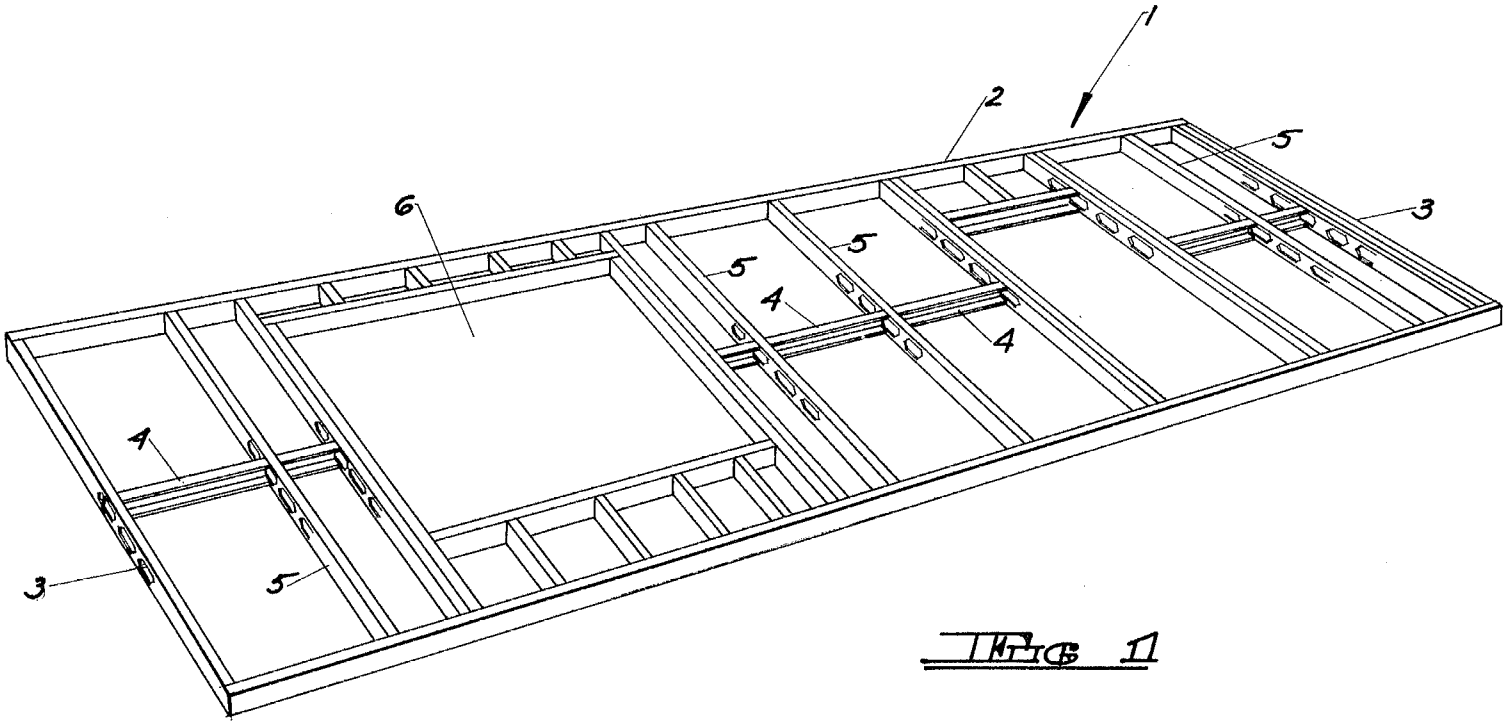
FIG. 1 is a fragmentary top perspective view of a partially completed modular building panel prior to assembly of the supporting base.

Fabrication of a typical prefabricated modular building panel commences with the assembly of a supporting frame work, shown generally at 1 in FIG. 1, formed by a plurality of rigidly interconnected stud members. A generally rectangular frame is formed by a pair of spaced parallel longitudinally extending channel-shaped steel stud members 2 which are rigidly connected at their ends by means of a pair of similarly configured transversely extending stud members 3. A plurality of intermediate longitudinally extending and transversely extending stud members 4 and 5, respectively, may also be provided to form a grid-like supporting frame work 1. Suitable portions of the intermediate stud members may be omitted, as at 6, to provide for door or window openings and the like. It will be understood that the stud members may be rigidly fastened by rivets, welding or the like.

A preferred method and apparatus for assembling framework 1 is illustrated in U.S. Pat. No. 3,945,630 issued Mar. 23, 1976 to J. C. Brunemann. The apparatus described contemplates an assembly support for the prefabricated building panel framework which assures accuracy in locating the stud members of the panels as well as the framing members and openings within the panels. In general, the assembly support illustrated in U.S. Pat. No. 3,945,630 will be positioned adjacent the apparatus of the present invention so that the partially completed panel framework 1 may be easily transferred to complete the assembly. Together, the assembly support and the apparatus of the present invention form an integrated system for facilitating the accurate and rapid fabrication of prefabricated modular building panels of the type described.

Figure 2:
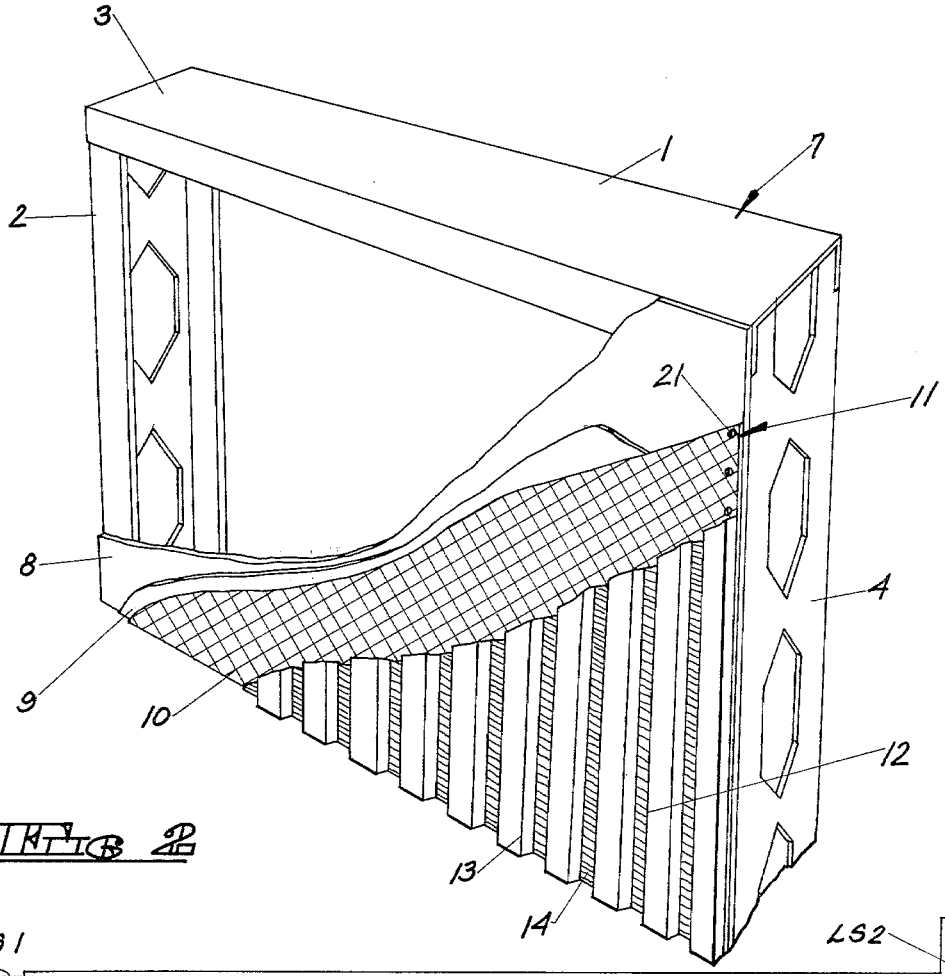
FIG. 2 is a fragmentary cut-away front perspective view of a completed modular building panel fabricated with the apparatus of the present invention.

As described hereinabove, the completed building panel will appear substantially as shown at 7 in FIG. 2. Panel 7 includes the metallic framework 1, only a portion of which is illustrated in FIG. 2. Framework 1 is covered by one or more planar sheets of exterior gypsum sheeting 8 to improve the fire rating of the completed panel 7, and a layer of felt paper 9 to enhance the Vapor Barrier properties of the panel. A layer of metal lath 10 overlies felt paper 9. Together, gypsum sheeting 8, felt paper 9 and metal lath 10 form a supporting layer or base 11 for the exterior cementitious coating or layer indicated generally at 12.

As indicated hereinabove, cementitious layer 12 may be provided with a plurality of generally parallel extending ribs 13 and flutes 14. As used herein, cementitious material refers to any liquid or fluid material which may be spread in a layer on the outer surface of support base 11, and which will form a generally self-supporting layer. It will be understood that the term particularly refers to cement, concrete and similar materials conventionally used as the exterior coating or layer on prefabricated modular building panels.

Figure 4A:
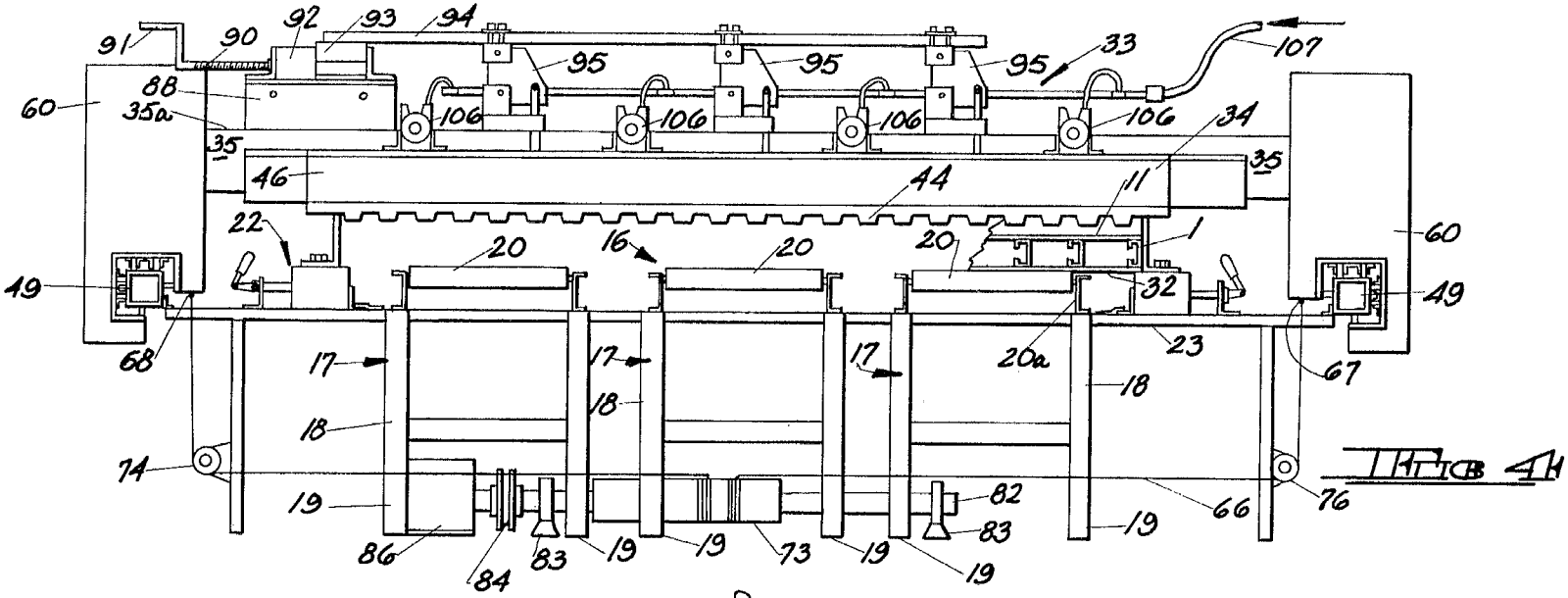
FIG. 4 is a fragmentary front elevation view of the apparatus of FIG. 3.
Figure 5:
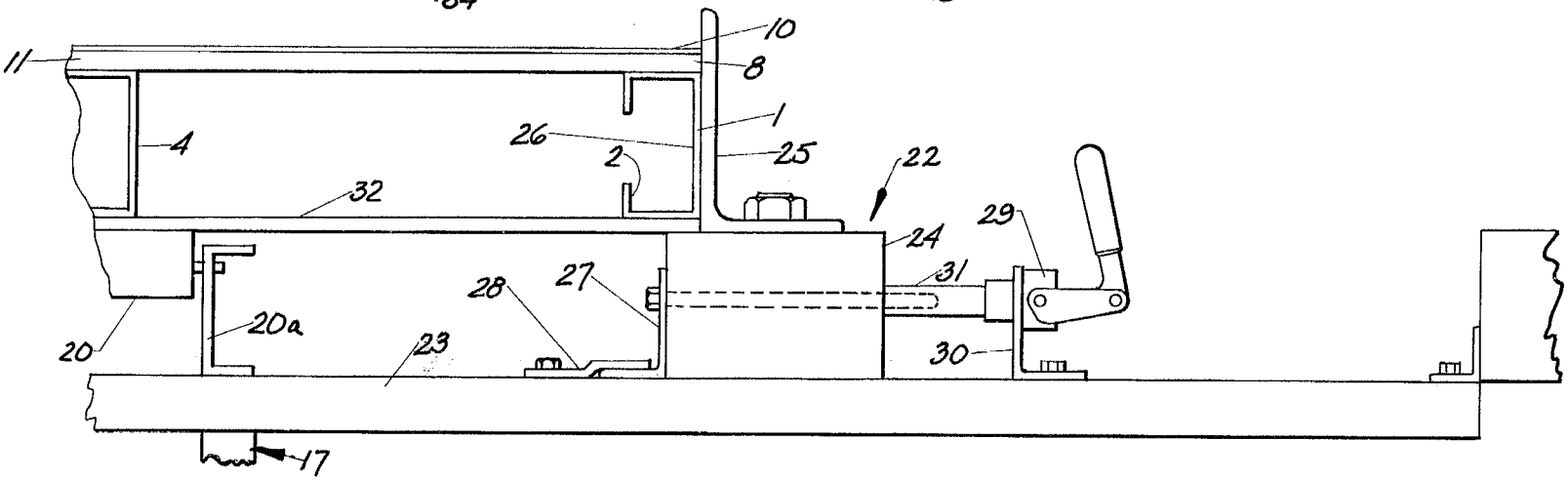

The apparatus for producing the prefabricated building panels of the present invention is illustrated in FIG. 3–FIG. 4 generally at 15, and may be referred to as a screed machine. In general, screed machine 15 comprise a generally horizontal planar bed 16 made up of three equally spaced elongated roller bearing conveyor assemblies 17. Each conveyor assembly 17 includes a stand portion 18 having a plurality of vertically extending supporting legs 19, the lower ends of which rest upon the floor. The upper end of conveyor stands 18 rotatably support a plurality of spaced rollers 20 having substantially co-planar upper surfaces. As best shown in FIG. 3, bed 16 will be of sufficient width and length to support in a generally horizontal orientation one or more of modular building panel frameworks 1.

As noted hereinabove, one or more frameworks 1 fabricated by means of the assembly support illustrated in U.S. Pat. No. 3,945,630 are positioned on the upper surface of rollers 20 forming bed 16 such that the edges of the stud members which will be in contact with exterior gypsum sheeting 8 are facing upwardly. It will be observed that the conveyor assemblies 17 facilitate the movement of the framework 1 onto bed 16 of screed machine 15.

With framework 1 in place, the exterior gypsum sheeting, felt paper 9 and metal lath 10 may be secured to the upwardly facing edges of the stud members by means of rivets, screws or the like 21, thus forming support base 11.

As noted, the spacing between conveyor assemblies 17 may be adjusted to provide for or handle frameworks of various widths. Furthermore, legs 19 of conveyor stands 18 may be made adjustable for leveling bed 16. In some installations it may be desirable to adjust legs 19 to provide a slight slope to bed 16 to facilitate removing the completed panel from the apparatus. Furthermore, a number of panels may be processed simultaneously by placing them side-by-side or end-to-end.

Figure 5:
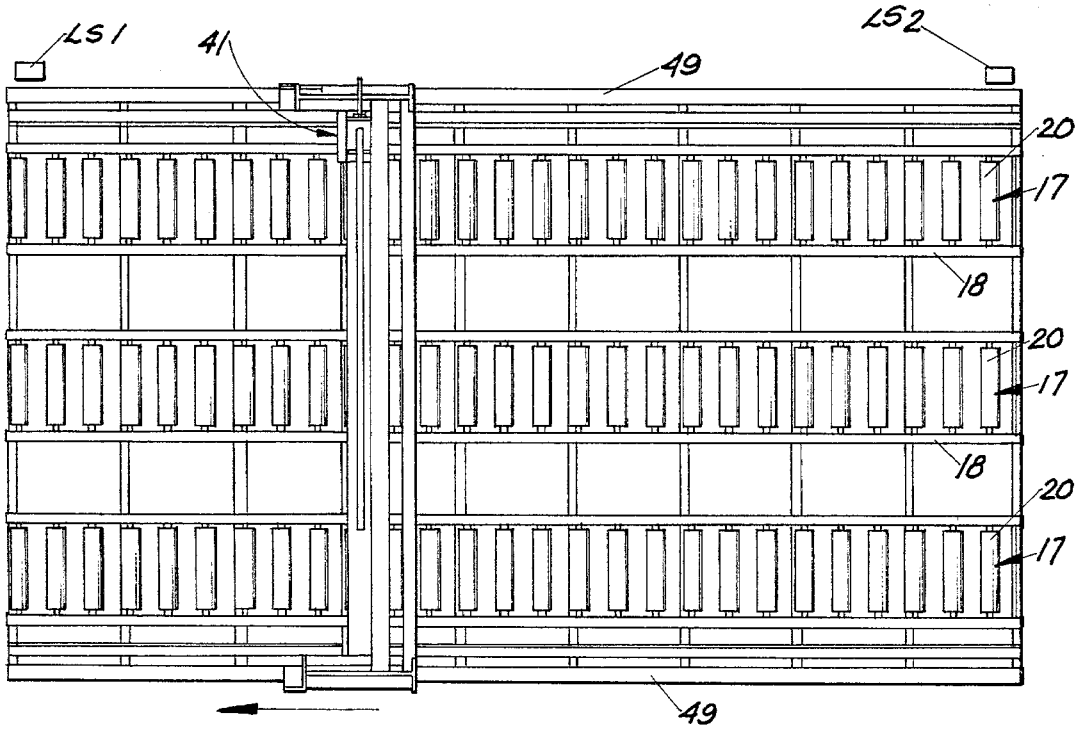
FIG. 5 is an enlarged fragmentary front elevation view of the clamping means of the present invention with a partially completed modular building panel in place.

Clamp means, shown generally at 22, are illustrated in FIG. 4 and FIG. 5 for holding panel framework 1 in a fixed position with respect to bed 16. Clamp means 22 is mounted on a Unistrut 23 which also serves to support mounting bracket 20*a* for rollers 20. A mounting block 24 is slidably secured to the upper surface of the Unistrut 23 and bears an upwardly extending pressure plate 25 having a relatively smooth inner surface 26 for abutting the outer surface of longitudinal outer stud members 2 forming panel framework 1. The innermost face of mounting block 24 includes angle member 27 cooperating with stop member 28 adjustably secured to the upper surface of Unistrut 23 to limit the travel of mounting block 24. A cam-lock clamping mechanism 29 is also secured to the upper surface of Unistrut 23 by means of angle bracket 30 and serves to force mounting block 24 and pressure plate 25 inwardly against the side edges of framework 1 through connecting rod 31. It will be observed that a plurality of clamp means 22 may be spaced on bed 16 along the longitudinal edges of framework 1 to securely hold the panel framework in position. Furthermore, inasmuch as the position of clamp means 22 is adjustable transversely of the framework by means of stop member 28 and angle bracket 30, panel frameworks of various widths may be accommodated. In general, the height of pressure plate 25 will be selected so that the uppermost edge of the pressure plate is positioned slightly below the upper surface of the finished exterior cementitious layer or coating 12. In addition, a sheet of plywood or the like 32 may be positioned between framework 1 and rollers 20 to vertically position the framework as well as distribute the weight evenly over the rollers. In any event, it will be observed that the upper surface of mounting block 24 does not serve as a support for the panel. Similar clamping means and supports may be provided on the opposite side of bed 16 as illustrated in FIG. 4.

Figure 10:
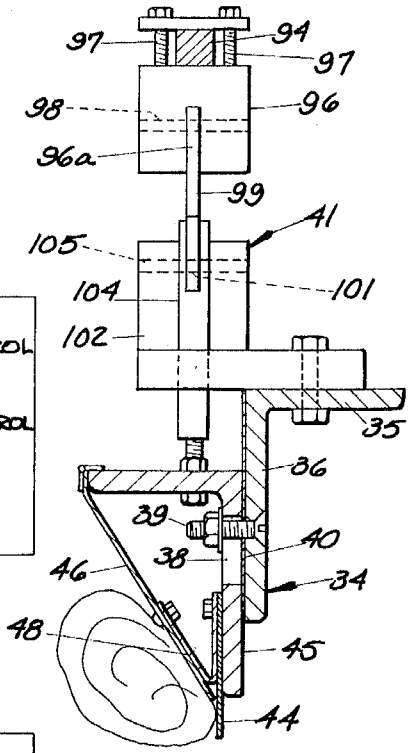
FIG. 10 is a fragmentary enlarged cross sectional view of the screed means of the present invention.
Figure 11:
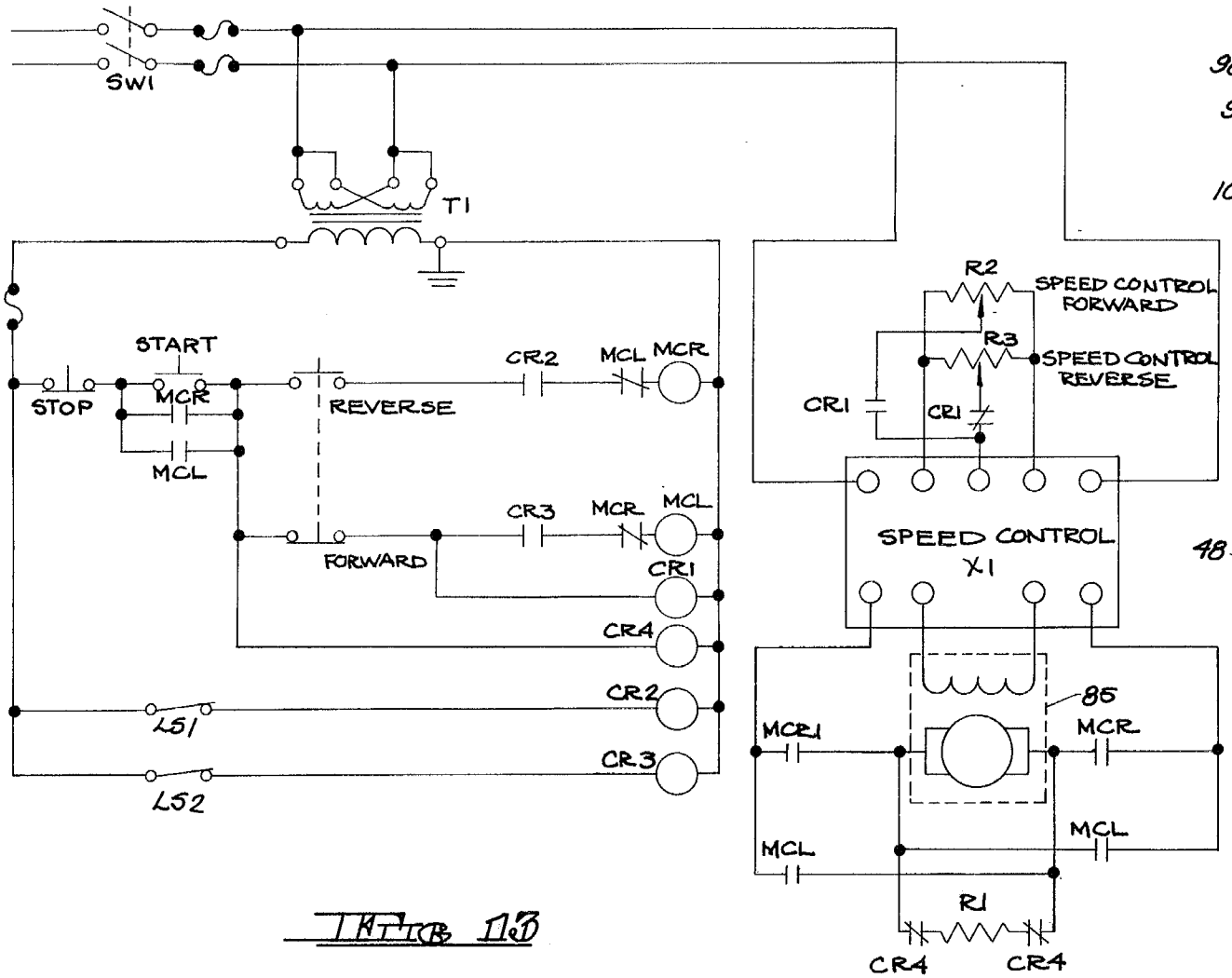

Screed means, shown generally at 33, are provided for traversing bed 16 in a direction parallel to the longitudinal axis of the panel to spread and texture the cementitious coating or layer 12 over the upper surface of support base 11. Screed means 33 includes an elongated screed 34 extending transversely across bed 16 and movable along the longitudinal axis of the bed. As best shown in FIG. 10, screed 34 comprises an angled mounting bracket 35 having a downwardly depending leg 36. A second similarly configured mounting bracket 37 bearing a guide slot 38 is adjustably secured to leg 36 of mounting bracket 35 by means of threaded fastener 39. If desired, a non-metallic liner 40 may be positioned between the mating faces of brackets 35 and 37 to minimize sliding friction. As will be explained in more detail, a vertical adjusting mechanism shown generally at 41 is secured to the upper horizontal web portion 42 of bracket 37 as at 43 in order to provide relative vertical movement between mounting bracket 35 and mounting bracket 37.

Figure 8:
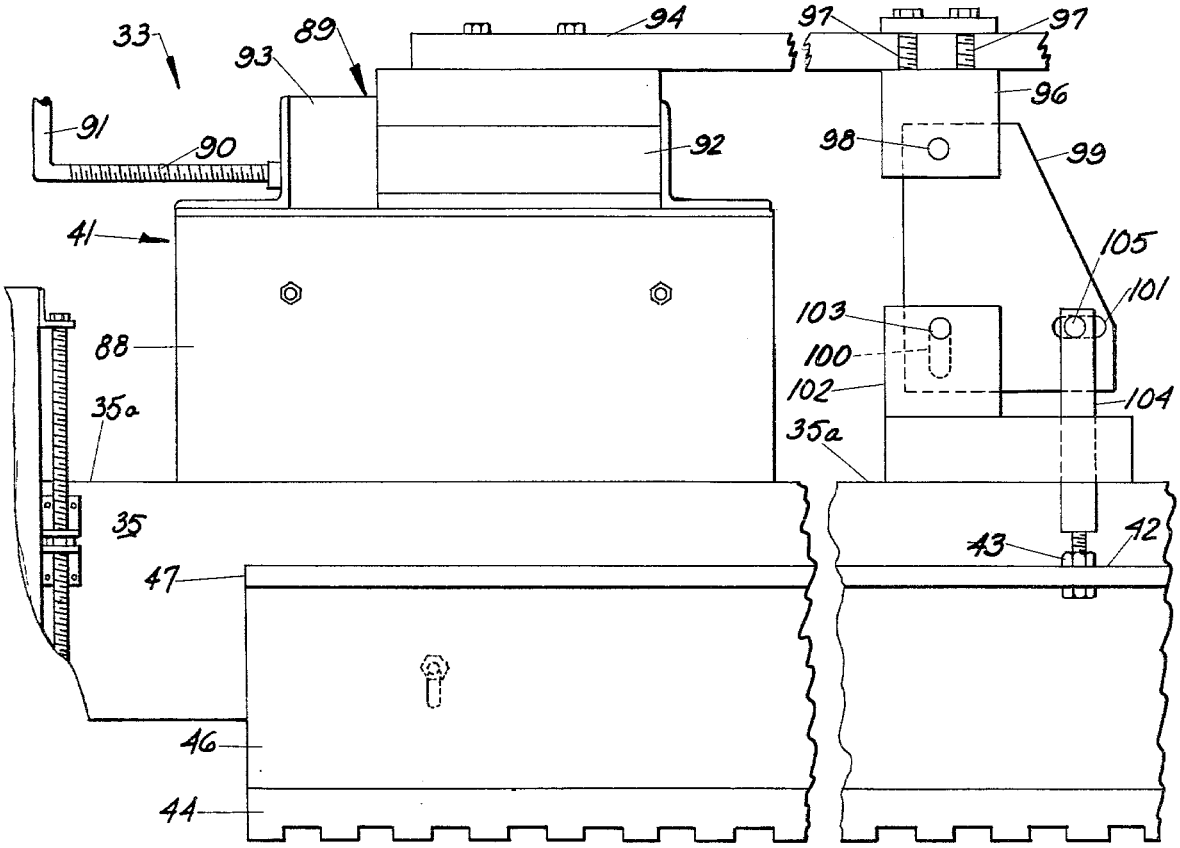
FIG. 8 is a fragmentary enlarged front elevation view of the lifting mechanism for the screed means of the apparatus of the present invention.
Figure 9:
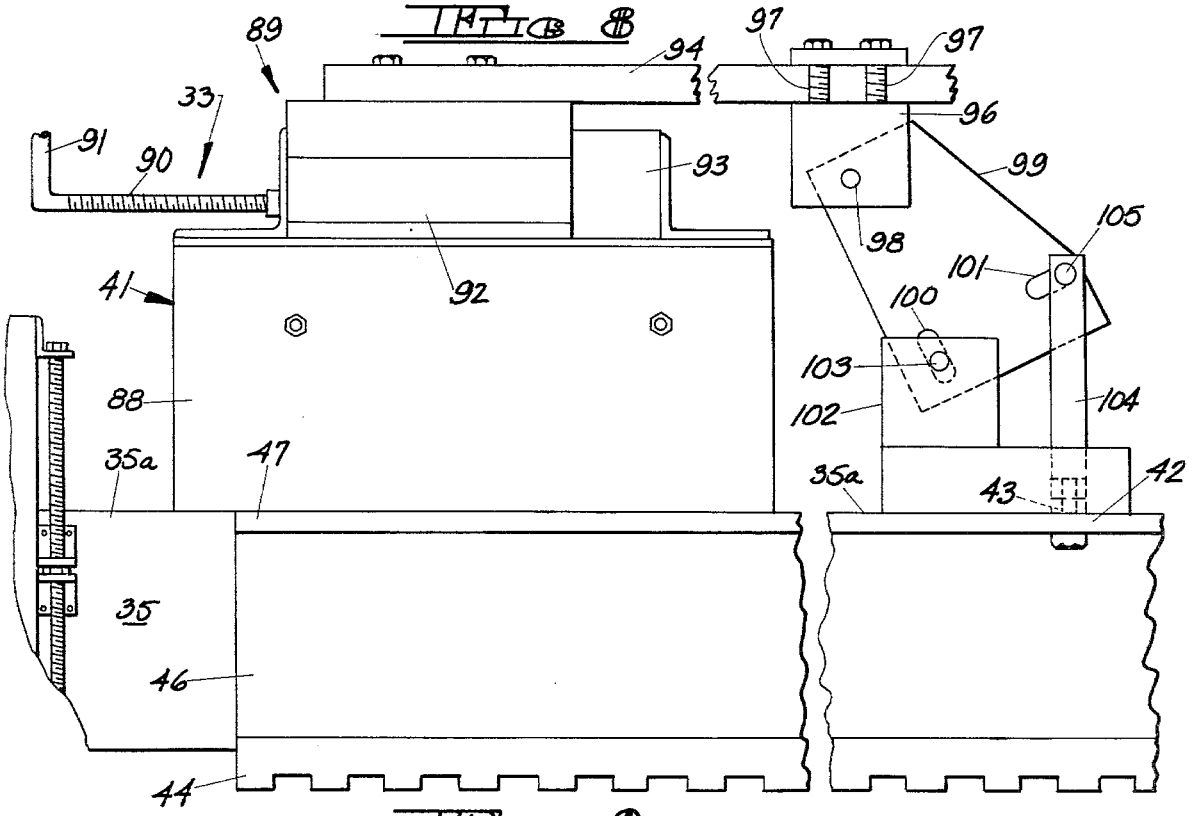
FIG. 9 is an alternate position of the lifting mechanism illustrated in FIG. 8.

An elongated texturing blade or screed plate 44 is removably attached to the vertical leg 45 of movable bracket member 37. As best shown in FIG. 4, texturing blade 44 may be provided with a scalloped, serrated or toothed edge to produce the desired texture in the coating or layer 12 of cementitious material on the exterior surface of the panel. While the configuration illustrated is designed to produce a panel surface having alternating ribs 13 and flutes 14, it will be understood that other configurations may be provided to produce different textures. Furthermore, a smoothly surfaced panel may be produced by a configured texturing blade 44 having substantially a straight lower edge. Furthermore, texturing blade 44 is made removable so that different blades may be used on the same machine to produce different textured exterior finishes on the panel. "Configured blade" as used hereinafter is intended to mean a blade having an edge other than straight, for example; a blade as shown in FIGS. 4, 8 and 9.

A continuous angled plate 46 extends upwardly and forwardly from texturing blade 44 to the forward edge of upper web portion 42 of bracket 37 where it is attached thereto by means of a hinge 47. The lower portion of angle plate 46 is attached to leg 45 of bracket 34 by means of a V-shaped mounting bracket 48. It will be observed that this construction permits angle plate 46 to be swiveled downwardly to facilitate replacement or repair of texturing blade 44. It will also be observed that the exterior angle formed between texturing blade 44 and angle plate 46 will be of the order of 150° in order to cause the cementitious material to roll in a downward direction as screed 34 traverses the upper surface of support base 11 of the building panel. However, the specific angle will generally depend on the slump of the concrete. In any event, the angle will be such as to key the cementitious material into metal lath 10.

A generally box-like guide rail 49 is secured to each side of bed 16. Guide rail 49 includes upper and lower generally horizontal surfaces 50 and 51, respectively, and generally vertical inner and outer side surfaces 52 and 53, respectively.

Figure 6:
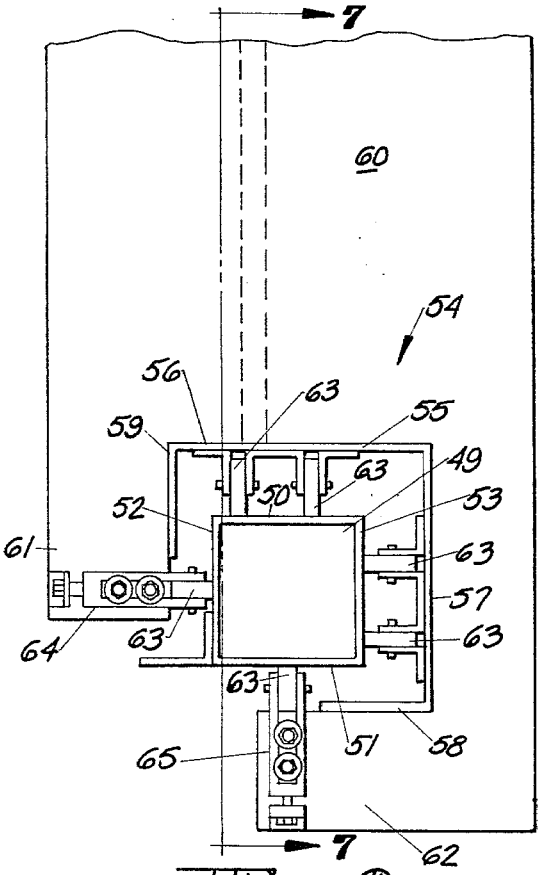
FIG. 6 is an enlarged fragmentary front elevation view of the supporting means and guide rail structure for the apparatus of the present invention.
Figure 7:
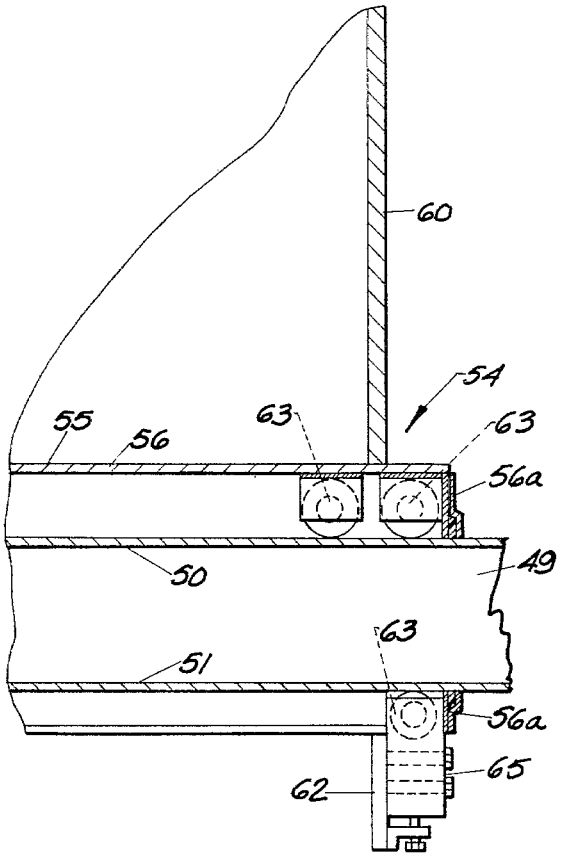
FIG. 7 is a fragmentary cross sectional view taken along section line 7—7 of FIG. 6.

Support means, shown generally at 54, are provided for supporting each end of screed 34 to insure parallel movement of the screed along guide rails 49. As best shown in FIG. 6 and FIG. 7, support means 54 includes a channel-shaped elongated guide support 55 having a generally horizontal upper plate 56, a generally vertical outer plate 57 depending downwardly from the outer edge of upper plate 56, a generally horizontal web portion 58 extending inwardly from the lower edge of outer plate 57, and a generally vertical web portion 59 depending downwardly from the inner edge of upper plate 56. A generally vertical mounting plate 60 having a downwardly extending arm 61 positioned inwardly of guide rail 49, and an inwardly extending lower arm 62 extending beneath guide rail 49 is attached to guide support 55 as best shown in FIG. 6 and FIG. 7.

Movement of screed 34 is restricted to a direction parallel to the longitudinal axis of bed 16 by means of a plurality of wheel-like guide rollers 63 attached to guide support 55 and mounting plate 60. Two spaced pairs of such rotatably mounted guide rollers are secured to the under surface of upper plate 56 so as to make rolling contact with upper horizontal surface 50 of guide rail 49. A similar vertically spaced pair of guide rollers 63 is secured to the inner surface of outer plate 57 to make rolling contact with the outer side surface 53 of guide rail 49. A horizontally extending guide roller 63 is mounted to downwardly extending arm 61 by means of a horizontal adjustment 64. Similarly, a vertically extending guide roller 63 is mounted to horizontally extending lower arm 62 by means of a vertical adjustment 65. In general, adjustments 64 and 65 position their respective rollers 63 against the respective sufaces of guide rail 59 to insure that the rollers remain in contact with the guide rail as screed 34 traverses bed 16. This not only maintains the parallelism of screed 34, but also prevents variations in the horizontal and vertical positon of the screed which might cause ripples in the surface of the exterior cementitious coating on the panel. If desired, a felt wiper and dirt seal 56*a* may be provided in sliding contact with the outer surface of guide rail 49 to insure free passage of screed 34.

Figure 11:
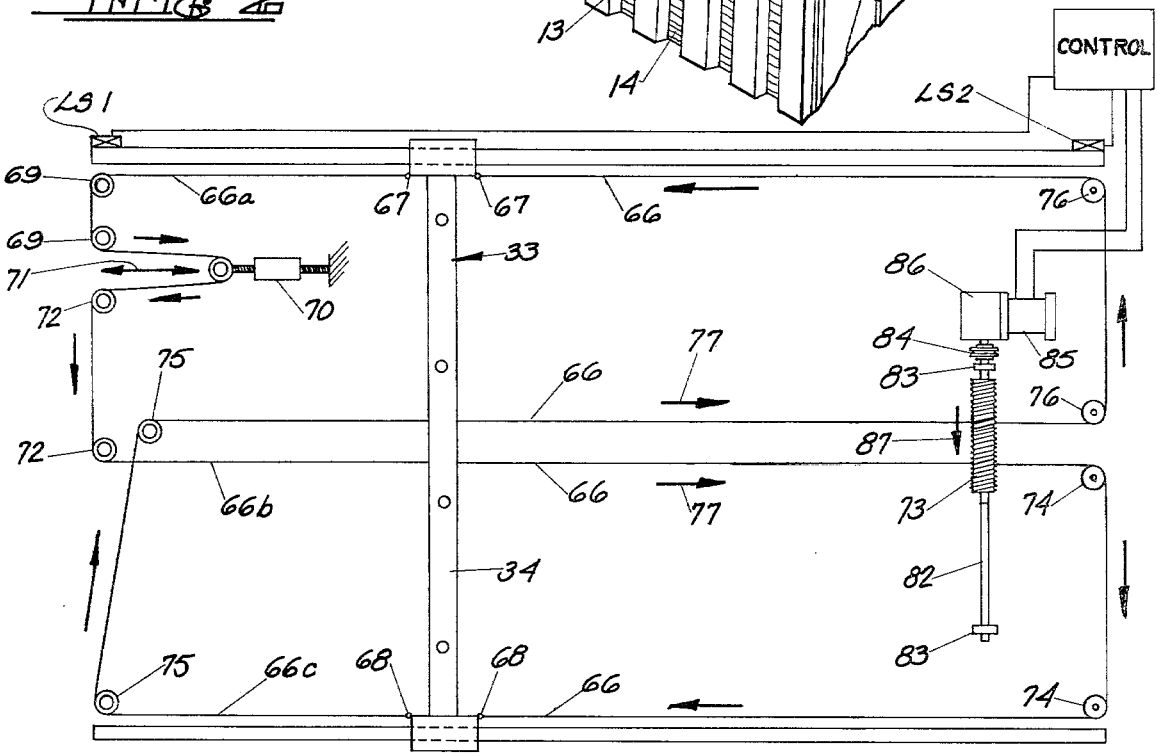
FIG. 11 is a diagrammatic view of the traversing mechanism of the present invention.

Screed 34 is traversed along bed 16 by means of a continuous flexible cable 66 forming a closed loop as illustrated diagrammatically in FIG. 11. Cable 66 is secured at spaced points along its length to the ends of screed 34 as at 67 and 68. The portion of cable 66 designated 66*a* continues rearwardly around a pair of spaced sheaves 69 to cable tension adjustment mechanism 70, which may be moved in the direction of directional arrow 71 to increase or decrease the tension in cable 66. Cable 66 continues around sheaves 72 positioned near the rear portion of screed machine 15, with cable portion 66*b* continuing forwardly at approximately the midpoint of bed 16 to rotatable drum 73. Cable 66 continues forwardly around sheaves 74 positioned near the forward end of screed machine 15 and thereafter rearwardly to point of attachment 68 on the end of screed 34. Rear portion 66*c* continues around rearwardly positioned sheaves 75 and continues forwardly substantially parallel to cable portion 66*b* to rotatable drum 73. The cable then passes around forwardly positioned sheave 76 and then rearwardly to point of attachment 67 on the end of screed 34.

It will be observed that tension applied to cable 66 in the direction of arrows 77 will cause screed 34 to move in a rearwardly direction toward cable tension adjustment 70. Conversely, tension applied to cable 66 in the opposite direction will cause screed 34 to move forwardly toward rotatable drum 73.

Figure 12:
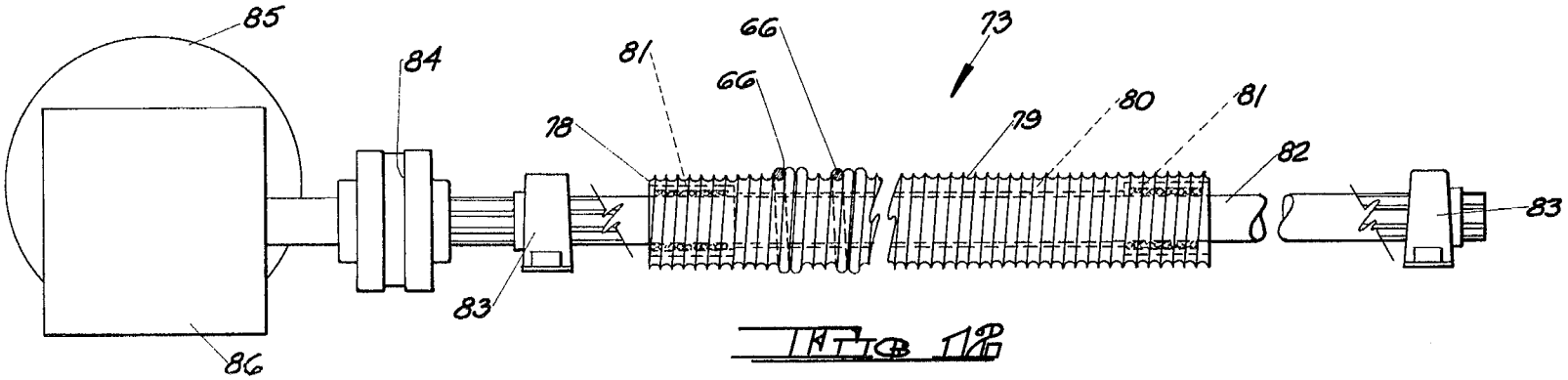
FIG. 12 is an enlarged fragmentary front elevation view of the roller means associated with the apparatus of the present invention.

Rotatable drum or roller means 73 is illustrated in FIG. 12 and comprises a generally cylindrical roller 78 having a continuous helical groove 79 inscribed in its outer surface. As illustrated, groove 79 is furnished with a right-hand thread. At least two wraps of cable 66 are provided within grooves 79 for those portions of the cable guided by inner sheaves 74 and 76, respectively. In a preferred embodiment, groove 79 will have a depth of approximately 25% of the cable diameter to maintain frictional contact between the cable and roller.

Cylindrical roller 78 includes an axial bore 80 extending therethrough which is dimensioned to accept a pair of spaced linear spline bearings 81 at either end of roller 78. A generally cylindrical splined shaft 82 extends through bore 80 such that roller 78 is linearly but non-rotatably movable on the spline shaft 82.

The ends of shaft 82 are rotatably supported by means of a pair of spaced pillow blocks 83. One end of shaft 82 is connected by means of coupling 84 to a reversible DC motor 85 operating in connection with a reducing gear drive 86.

As will be explained in more detail hereinafter, rotatable drum 73 is initially positioned near one end of splined shaft 82 as illustrated in FIG. 11, with the screed 34 at the rearmost limit of travel. Reversible DC motor 85 is activated to cause splined shaft 82 and cylindrical roller 78 to rotate in a direction to move screed 34 forwardly. As this occurs, the portions of cable 66 wrapped about cylindrical roller 78 tend to stay in approximately the same position. At the same time, roller 78 tends to move in the direction of directional arrow 87 toward the opposite end of splined shaft 82. By the time that screed 34 has reached its forwardmost limits of travel, roller 78 will be positioned adjacent the pillow block 83 supporting the opposite end of shaft 82. Consequently, rotatable drum 73 will be of sufficient length to accommodate the entire traverse of screed 34 along bed 16. This construction prevents tracking of the cable on the drum, and insures substantially constant tension in cable 66 to move screed 34 smoothly along bed 16. It will be understood that reversing the direction of rotation of reversible DC motor 85 will cause the reverse sequence of events to occur such that screed 34 moves rearwardly and rotatable drum 73 moves in a direction toward DC motor 85 as illustrated in FIG. 11.

For purposes of an exemplary showing, a control circuit for operating screed machine 15 of the present invention is illustrated in the schematic diagram of FIG. 13. With main disconnect switch SW1 closed, primary power is applied through isolation transformer T1 to the switching network illustrated in the left portion of the diagram and to the speed control network illustrated in the right portion of the diagram. With the STOP SWITCH closed, movement of screed 34 will commence when the START SWITCH is closed, thereby energizing relay CR4 to close the relay contacts associated with resistor R1 and the armature of reversible DC motor 85.

With the FORWARD SWITCH closed, as illustrated in FIG. 13, relay CR1 will be energized to close the relay contacts associated with variable resistor R2 to supply the necessary control voltages to speed control X1, which may be of the type VE300C manufactured by Boston Gear Company. It will be observed that variable resistor R2 permits the speed of screed 34 to be set at a predetermined value when the screed is moving in a forward direction. For example, for a particular type of surface coating, screed 34 may be caused to move at a speed of approximately two feet per minute. However, the speed control may be adjustable over a wider range, such as up to 78 feet per minute, for particular types of coating applications.

With the conditions described, and limit switch LS2 normally closed, relay CR3 will be energized to energize relay MCL, thereby shunting the START SWITCH. These conditions will continue until the screed 34 reaches the forwardmost limits of travel as detected by electromagnetic limit switch LS2, as illustrated in FIG. 3. At this point limit switch LS2 is opened, thereby energizing relays CR3 and MCL, to stop reversible DC motor 85. The position of the FORWARD/REVERSE SWITCH may be automatically moved to the alternate position at this point, or reversal of the screed may be manually initiated. In either event, relay MCR will be energized to cause screed 34 to move in the reverse direction. The speed of screed 34 in the reverse direction may be set by means of variable resistor R3 in association with speed control X1. When screed 34 reaches the rearmost limit of travel, electromagnetic switch LS1 will be opened, terminating screed movement in the reverse direction. In a preferred embodiment, the speed in the reverse direction may be somewhat higher than that in the forward direction so that another pass may be immediately made. In some instances, however, only a single pass over the panel may be necessary to produce the necessary exterior finish.

The vertical lifting mechanism 41 associated with the present invention is illustrated in greater detail in FIG. 8 and FIG. 9. In general, a similarly configured lifting mechanism 41 will be provided at each end of screed 34 and operated to vertically position texturing blade 44 with respect to the cementitious coating 12 on the building panel, as well as to minimize sag in the central portion of the screed 34.

In a preferred embodiment, lifting mechanism 41 includes a mounting block 88 fixedly secured to the upper web portion 35*a* of angled mounting bracket 35. A rotary to linear motion converter 89 is mounted upon mounting block 88 and is operated by means of helical screw 90 terminating in a handle portion 91. As helical screw 90 is rotated, the outer shell portion 92 of motion converter 89 moves with respect to the fixed inner portion from the position illustrated in FIG. 8 to the position illustrated in FIG. 9. An elongated support bar 94 is fixedly secured to the upper surface of movable outer portion 92. Consequently, rotation of handle portion 91 in the appropriate direction causes linear movement in the right or left of support bar 94 as viewed in FIG. 8 or FIG. 9.

The vertically movable portion of screed 34 formed by mounting bracket 37 is suspended at spaced locations along support bar 94 by means of three similarly constructed pivot mechanisms 95 (see FIG. 4). Pivot mechanism 95 includes a slotted pivot block 96 fixedly secured to support bar 94 by means of threaded fasteners 97. Pivot block 96 bears a generally cylindrical pin 98 which pivotally supports a pivot plate 99 which is free to pivot within slot 96*a* of pivot block 96, as illustrated in FIG. 8, FIG. 9 and FIG. 10.

The lower portion of trapezoidal-shaped pivot plate 99 bears a pair of spaced perpendicularly oriented elongated slots 100 and 101, respectively. Pivot plate 99 is pivotally secured to a bracket 102 extending upwardly from the upper surface 35*a* of fixed mounting bracket 35 by means of a pivot pin 103 extending through slot 100.

Pivot plate 99 is attached to the upper web portion 42 of movable mounting bracket 37 by means of a vertically extending link 104 which is pivotally secured to pivot plate 99 by means of a pivot pin 105 extending through slot 101. The lower end of link 104 is fixedly secured to web portion 42 as at 43.

In operation, as handle portion 91 is rotated in the appropriate direction, the movable outer portion 92 of the rotary to linear motion converter 89 moves from the position illustrated in FIG. 8 to the position illustrated in FIG. 9. This action causes support bar 94 to move linearly in the same direction, displacing the upper end of pivot plate 99. The lower portion of the pivot plate rotates about pivot pin 103, causing link 104 to move upwardly drawing the movable portion of the screed 34 upwardly and consequently raising texturing blade 44. To lower the movable portion of the screed, handle 91 would be rotated in the opposite direction, causing the reverse sequence of events to occur. It will be observed that this adjustment permits low places in the exterior cementitious coating 12 to be filled, and also permits the screed 34 to be retracted in the reverse direction with texturing blade 44 out of contact with the exterior surface of the modular building panel. As illustrated in FIG. 10, the movable and fixed portions of the screed 34 slide easily with respect to each other along the surfaces presented by liner 40.

To assist in working the cementitious coating into the metal lath structure associated with the building panels, a plurality of spaced pneumatically operated vibrators 106 are fixedly secured to the upper edge of screed 34 as best shown in FIG. 4. Air under pressure is supplied to pneumatic line 107 and distributed to each of vibrators 106 causing random vibrations which are transmitted to screed 34. The vibratory forces induced in the screed thus assist in working the cementitious material as the screed traverses the panel surface.

In operation, the cementitious material is manually or mechanically spread immediately in front of the texturing blade 44 before or during forward motion of screed 34. As illustrated in FIG. 10, the screed operates to roll the cementitious material downwardly and, assisted by the vibratory action of the screed, to key the cementitious material into the metal lath 10 of the panel. When the screed reaches the limits of forward travel as detected by electromagnetic limit switch LS2, the DC motor 85 may be disengaged or reversed. In some instances, another pass may be necessary to produce the desired texture. In this event, the screed 34 is raised by means of vertical lifting mechanism 41, and thereafter lowered into position before another forward pass is made.

Figure 14:
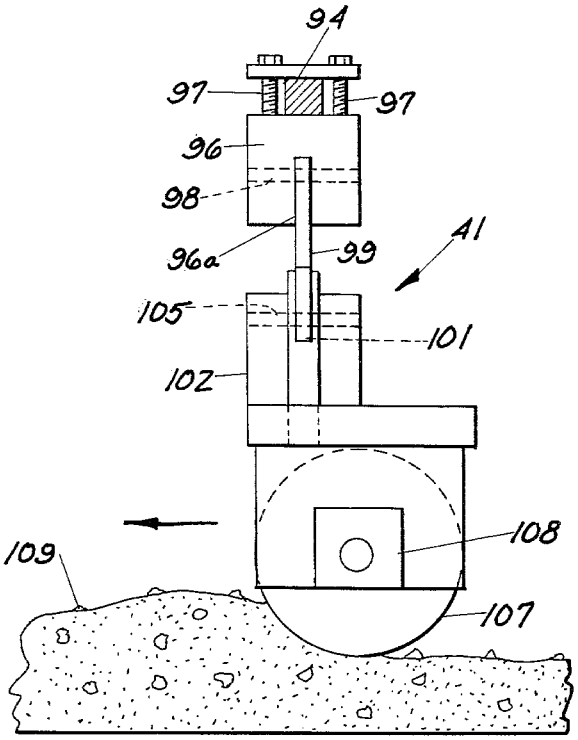
FIG. 14 is a fragmentary side elevation view of an alternative embodiment of the apparatus of the present invention using a roller to replace the screed means.

A second embodiment of the screed 34 of the present invention is illustrated in FIG. 14. In this instance, the scraper-like screed mechanism has been replaced by a Teflon coated cylindrical roll 107 which is rotated as the screed traverses through a gear box 108. This arrangement also serves to spread and texture the cementitious material coating, and has been found to be particularly advantageous when relatively large aggregate material such as that illustrated at 109, is included in the cementitious coating. In all other respects, screed machine 15 will be similar in construction to that described hereinabove.

It will be understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. Apparatus for applying an exterior layer of cementitous material to a partially assembled prefabricated modular building panel of the type having a rigid framework composed of a plurality of rigidly interconnected stud members and a support base secured to the framework having an outer surface configured to retain the cementitous material, said apparatus comprising:

a generally-horizontal planar bed for supporting the partially assembled panel in a horizontal position with the outer surface of the support base facing upwardly;

screed means overlying said bed for spreading cementitous material over the outer surface of the panel support base, said screed means comprising an elongated screed extending transversely across said bed and movable horizontally along the longitudinal axis of the bed, and texturing means secured to said screed and vertically positioned to contact the exterior layer of cementitous material applied to the outer surface of the support layer, said texturing means comprising an elongated texturing blade attached to the lower end of said screed, said texturing blade configured to produce a desired surface texture in the cementitous layer as the screed traverses the bed;

an angled plate extending upwardly and forwardly from the front cementitous material contacting surface of said texturing blade for causing the cementitous material to roll downwardly as said screed traverses the bed; and means for traversing said screed over said bed to spread the layer of cementitous material over the outer surface of the panel support base.

2. The apparatus according to claim 1 wherein said clamp means comprises a plurality of vertically extending horizontally movable adjustable pressure plates spaced along the side edges of the panel framework, the inner surfaces of said plates being configured to abut the outer side edges of the panel framework.

3. The apparatus according to claim 1 wherein said texturing blade includes a toothed lower edge.

4. The apparatus according to claim 1 wherein said blade is detachable from said screed.

5. The apparatus according to claim 1 wherein said angled plate extends upwardly and forwardly at an exterior angle of about 150° from said texturing blade.

6. The apparatus according to claim 1 including hinge means hingedly attaching the upper end of said angled plate to the screed to permit the plate to be pivoted away from the texturing blade.

7. The apparatus according to claim 1 wherein said bed includes a plurality of spaced rotatably mounted rollers supporting the panel framework to facilitate removal of the completed panel from the bed.

8. The apparatus according to claim 2 wherein said rollers are mounted on a plurality of parallel spaced individually movable stands forming conveyors, said stands being laterally displaceable to accommodate panel frameworks of different widths.

9. The apparatus according to claim 1 wherein said texturing means comprising a generally cylindrical roller rotatably mounted to the lower edge of said screed.

10. The apparatus according to claim 9 including means for rotating said roller as said screed traverses the bed.

11. The apparatus according to claim 1 including means for vibrating said screed means.

12. The apparatus according to claim 11 wherein said vibrating means comprises a pneumatically operated vibrator.

13. The apparatus according to claim 1 wherein said traversing means includes a guide rail positioned along each side edge of the bed and support means for supporting each end of said screed means to insure parallel movement of the screed along said rails.

14. The apparatus according to claim 13 wherein said guide rail has a box-like configuration including top, bottom and side surfaces, and said support means includes a wheel-like guide rotatably secured to said screed in rolling contact with an associated surface of said rail, said guides operating to restrict movement of said screed in a direction parallel to the longitudinal axis of the bed.

15. The apparatus according to claim 1 including means for adjusting the vertical position of said blade with respect to the layer of cementitious material on the panel.

16. The apparatus according to claim 15 including a substantially continuous flexible cable forming a closed loop and attached at spaced points adjacent the ends of said screed, a generally cylindrical roller having a continuous helical groove on its outer surface, said cable being wrapped about said roller such that said cable rides within said groove, said roller including an axial bore extending therethrough, a pair of spaced linear spline bearings positioned within said bore at either end thereof, an elongated splined shaft positioned within said bore and said bearings such that said roller is slidably but non-rotatably secured to said shaft, and reversible motor means attached to said shaft for rotating said roller at a generally constant first speed in a direction to cause said screed to move in a forward direction, and at a generally constant second speed in a reverse direction to cause said screed to move in a reverse direction.

17. The apparatus according to claim 1 wherein said screed means includes an elongated rotatably mounted cylindrical roller extending transversely across said bed.

18. The apparatus according to claim 17 including means for rotating said roller as said screed traverses said bed.

19. The apparatus according to claim 1 including means for adjusting the vertical position of said blade with respect to the layer of cementitious material on the panel.

20. The apparatus according to claim 19 wherein said adjusting means comprises:

a support bar extending in vertically spaced parallel relationship above said blade;

means for causing linear displacement of said bar; and means securing said blade to said bar for causing vertical movement of said blade upon linear displacement of said bar.

21. The apparatus according to claim 20 wherein said linear displacement means comprises a rotary to linear converter.

22. The apparatus according to claim 20 wherein said securing means comprises a pivot plate depending downwardly from said bar, means pivotally attaching said plate to said bar, means pivotally and slidably securing said plate to said screed and means pivotally and slidably securing said plate to said blade.

23. The apparatus according to claim 22 including a plurality of said securing means positioned at spaced locations along said bar.

24. The apparatus according to claim 1 wherein said traversing means includes a flexible cable attached to said screed and means for applying tension to said cable to cause said screed to traverse the bed.

25. The apparatus according to claim 24 wherein said cable is substantially continuous and forms a closed loop, said cable being attached adjacent the ends of said screed.

26. The apparatus according to claim 25 wherein said tension applying means comprises roller means in frictional engagement with said cable and positioned adjacent one end of said bed for maintaining constant tension in said cable while preventing tracking of the cable, and motor means for rotating said roller means.

27. The apparatus according to claim 26 wherein said roller means comprises a generally cylindrical roller having a continuous helical groove on its outer surface, said cable being wrapped about said roller such that said cable rides within said groove, an elongated shaft attached to said motor means for rotation therewith, and means non-rotatably attaching said roller to said shaft so that said roller is free to move linearly along said shaft as the screed traverses the bed.

28. The apparatus according to claim 26 wherein said roller includes an axial bore extending therethrough and said attaching means comprises a pair of spaced linear spline bearings positioned within said bore at either end thereof, said shaft being splined and slidably but not rotatably secured within said bore and said bearings.

29. The apparatus according to claim 26 wherein said motor means includes means for causing rotation of said roller at a generally constant first speed in a direction to cause said screed to move in a forward direction and means for causing rotation of said roller at a generally constant second speed in the reverse direction to cause the screed to move in a reverse direction.

30. The apparatus according to claim 29 wherein said first and second speeds are different.

31. The apparatus according to claim 29 including means for sensing the position of maximum travel of said screed.

* * * * *